United States Patent [19]

Tanaka

[11] Patent Number: 4,799,051

[45] Date of Patent: Jan. 17, 1989

[54] DISPLAY CONTROL APPARATUS

[75] Inventor: Noriaki Tanaka, Kamakura, Japan

[73] Assignee: Mitsubishi Denki Kabushiki Kaisha, Japan

[21] Appl. No.: 58,906

[22] Filed: Jun. 5, 1987

[30] Foreign Application Priority Data

Jun. 12, 1986 [JP] Japan ..... 61-136744

[51] Int. Cl.[4] ..... G09G 1/00

[52] U.S. Cl. ..... 340/811; 340/733; 340/813

[58] Field of Search ..... 340/723, 811, 812, 813, 340/732, 733, 793, 767

[56] References Cited

U.S. PATENT DOCUMENTS

| | | | |
|---|---|---|---|
| 3,877,009 | 4/1975 | Kanie et al. | 340/798 |
| 4,001,806 | 1/1977 | Sweeting | 340/733 |
| 4,393,378 | 7/1983 | Danielsen et al. | 340/812 |
| 4,516,118 | 5/1985 | Wahlquist | 340/793 |
| 4,517,560 | 5/1985 | Murayama et al. | 340/723 |
| 4,604,614 | 8/1986 | Farr et al. | 340/732 |
| 4,672,451 | 6/1987 | Berger | 340/812 |

*Primary Examiner*—Gerald L. Brigance
*Assistant Examiner*—Jeffery A. Brier
*Attorney, Agent, or Firm*—Leydig, Voit & Mayer

[57] ABSTRACT

In a display control apparatus wherein a picture signal of a character, a pattern or the like and a luminance signal for affording a luminance to the picture signal are synchronously derived, and a logic between the picture signal and the luminance signal is taken to control the luminance of the picture signal; a display control apparatus comprising pulse width adjusters by which, when one signal is true with the other signal being false, the true signal is put within an interval of the false signal and is held false for fixed times before and after a true signal interval thereof, and when both logics of the respective signals are true or false, true or false intervals of both the signals are adjusted so as to become equal.

5 Claims, 8 Drawing Sheets

| | | PICTURE SIG | |
|---|---|---|---|
| | | TRUE | FAL |
| LUMINANCE SIG | TRUE | HIGH LUMINANCE DISP | NO DISP |
| | FAL | LOW LUMINANCE DISP | NO DISP |

DISPLAY CONTROL APPARATUS

BACKGROUND OF THE INVENTION

This invention relates to a display control apparatus wherein a picture signal for a character, a pattern or the like and a luminance signal for endowing the picture signal with a luminance are synchronously derived, and wherein the logic between the picture signal and the luminance signal is taken so as to control the luminance of the picture signal.

A prior-art display control apparatus of this type will be described with reference to FIGS. 6 thru 9.

FIG. 6 is a block diagram of the prior-art display control apparatus. In the figure, numeral 1 designates a picture signal generator which produces a picture signal, numeral 2 a luminance signal generator which produces a luminance signal, numeral 3 a sync signal generator which produces a sync signal for synchronizing the picture signal produced from the picture signal generator 1 and the luminance signal produced from the luminance signal generator 2, numeral 4 a data latch circuit which latches and then delivers the picture signal produced from the picture signal generator 1 and the luminance signal produced from the luminance signal generator 2 in order to synchronize these signals, numeral 5 the picture signal line of the data latch circuit 4 which delivers the synchronized picture signal, and numeral 6 the luminance signal line of the data latch circuit 4 which delivers the synchronized luminance signal.

FIG. 7 is a detailed block diagram of the picture signal generator 1 in FIG. 6. In the figure, numeral 17 indicates a memory which stores pictures therein, numeral 18 an address generator which produces an address for deriving the picture stored in the memory 17, and numeral 19 a parallel-to-serial converter which converts the parallel signals of the picture derived from the memory 17 on the basis of the output of the address generator 18, into serial signals and delivers them as a picture signal.

FIG. 8 is a detailed block diagram of the luminance signal generator 2 in FIG. 6. In the figure, numeral 22 indicates a memory which stores luminances therein, numeral 23 an address generator which produces an address for deriving the luminance stored in the memory 22, and numeral 24 a parallel-to-serial converter which converts the parallel signals of the luminance derived from the memory 22 on the basis of the output of the address generator 23, into serial signals and delivers them as a luminance signal.

FIG. 9 is a detailed block diagram of the sync signal generator 3 in FIG. 6. In the figure, numerals 27 indicate CMOS-type inverters which are connected in series into three stages, numerals 29 and 30 indicate first and second resistors which are connected in series between the input end of the first-stage inverter 27 and the output end of the third-stage inverter 27, respectively, and numeral 28 indicates a capacitor which is interposed between the node of the second-stage and third-stage inverters 27 and the node of the first and second resistors 29, 30.

Next, the operation of the prior-art display control apparatus thus constructed will be described.

In the picture signal generator 1, the memory 17 storing pictures therein is accessed using an address delivered from the address generator 18, so as to derive a picture composed of parallel signals. The derived picture composed of the parallel signals is converted by the parallel-to-serial converter 19 into a picture composed of serial signals, which is delivered to the data latch circuit 4 as a picture signal composed of time series pulses.

In this case, the operations of the address generator 18 and the parallel-to-serial converter 19 are performed in synchronism with pulses provided from the sync signal generator 3. Likewise, in the luminance signal generator 2, the memory 22 storing luminances therein is accessed using an address delivered from the address generator 23, so as to derive the luminance composed of parallel signals.

The derived luminance composed of the parallel signals is converted by the parallel-to-serial converter 24 into a luminance composed of serial signals, which is delivered to the data latch circuit 4 as a luminance signal.

Meanwhile, in the sync signal generator 3, an oscillator circuit is constructed of the series circuit of the inverters 27 connected in the three stages, the first and second resistors 29, 30 and the capacitor 28, whereby pulses at a predetermined frequency are delivered to the data latch circuit 4.

Here, on the basis of the pulses of the predetermined frequency produced from the sync signal generator 3, the data latch circuit 4 synchronizes the picture signal delivered from the picture signal generator 1 and the luminance signal delivered from the luminance signal generator 2 and provides the synchronized picture signal and luminance signal through the picture signal line 5 and luminance signal line 6, respectively.

Next, the relationship between the picture signal and the luminance signal will be described with reference to FIG. 10.

FIG. 10 is a diagram of the waveforms of the picture signal, luminance signal and sync signal. As illustrated in the figure, when one cycle of the sync signal is assumed to be a fundamental period, the pulse widths of the true and false levels of both the picture signal and the luminance signal are integral times the fundamental period, and also the phases of both the signals are in agreement.

FIG. 11 is a diagram in which the waveforms in one cycle of the sync signal in FIG. 10 are enlarged. As seen from the figure, the rises and falls of the pulses of the picture signal and the luminance signal require certain time intervals, which cannot become zero, so that the waveforms are distorted without becoming perfect square waves.

Now, another example of a prior-art display control apparatus will be described with reference to FIG. 12.

FIG. 12 has a block diagram showing the arrangement of the prior-art display control apparatus. In the figure, numerals 7 and 8 denote low-pass filters which are respectively disposed midway of the picture signal line 5 and luminance signal line 6 and each of which is construct ed of a coil and a capacitor.

In recent years, the prevention of EMI (electromagnetic interference) has been requested. In this example of arrangement, therefore, the low-pass filters 7 and 8 are disposed so that radio frequencies may not be transmitted to, for example, an external interface portion.

In this case, the rise $T_r$ and fall time $T_f$ of the pulses of the picture and luminance signals shown in FIG. 11 become even longer.

Next, the relationship of display statuses to the logics of the picture signal and luminance signal will be described with reference to FIG. 13.

FIG. 13 is a table which expresses the relations of the display statuses with the logics of the picture and luminance signals. As indicated in the figure, in a case where the logic of the picture signal is false, no display is presented, and the logic of the luminance signal is neglected. In a case where the logic of the picture signal is true, the luminance signal becomes significant, and it is logically required that the luminance of the display change depending upon the logic of the luminance signal.

As described above, with the prior-art display control apparatus, it is logically required that no display be presented in the case where the picture signal is false and where the luminance signal is true. Due to rise and fall times of the signals, both picture and luminance signals, being above a threshold value, are considered true during time intervals $Tl_1$ and $Tl_2$, as shown in FIG. 14. than the response time of the display equipment, there is the disadvantage that, unlike the no-display status, high luminance displays are presented as abnormal displays during the time intervals.

SUMMARY OF THE INVENTION

This invention has been made in order to eliminate the problem as stated above, and has for its object to provide an apparatus by which displays as logically determined can be presented for all the combinations of the logics of output signals.

To the accomplishment of the object, the display control apparatus according to this invention is characterized by comprising pulse width adjusters by which, when one signal is true With the other signal being false, the true signal is put within the interval of the false signal and is rendered false for fixed times before and after the true signal interval thereof, and when the logic of both signals are either true or false, the true or false intervals of both signals are adjusted to become equal.

With the pulse width adjusters 13 and 14 according to this invention, when one signal is true with the other signal being false, the true signal is put within the interval of the false signal, and it is rendered false for the fixed times before and after the true signal interval thereof. In addition, when both logics of the respective signals are either true or false, the true or false intervals of both the signals are adjusted to be equal.

DESCRIPTION OF THE PREFERRED EMBODIMENTS

Figure 1:
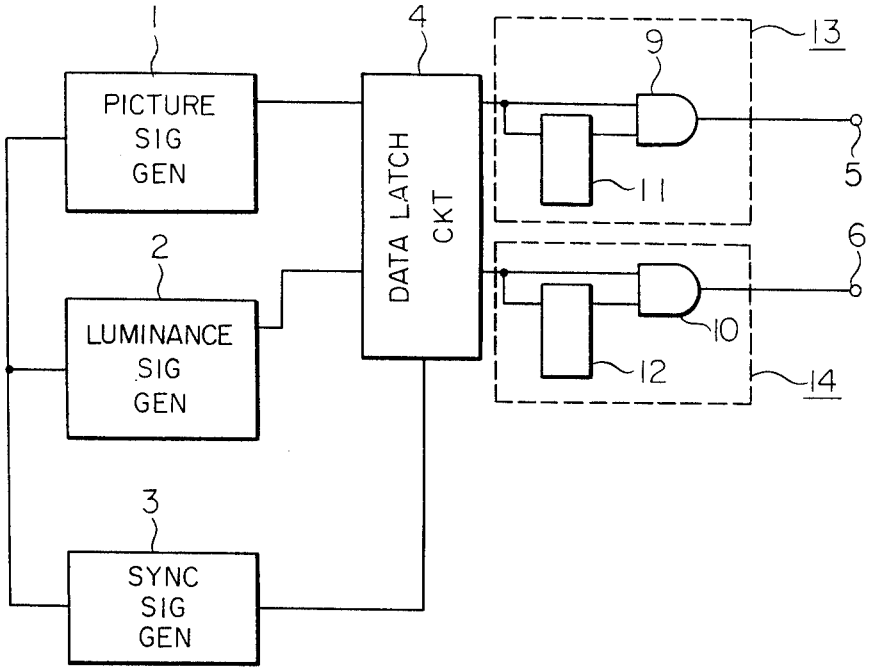
FIG. 1 is a block diagram showing an embodiment of the present invention.

Now, an embodiment of the present invention will be described with reference to the drawings. FIG. 1 is a block diagram showing one embodiment of the present invention, in which numerals 1–6 denote the same constituents as in the prior art, and numerals 13 and 14 denote pulse width adjusters connected between the outputs of the data latch circuit 4 and the picture signal line 5 and the luminance signal line 6, respectively.

The pulse width adjuster 13 is configured of a delay circuit 11 which delays and then transmits a picture signal delivered from the data latch circuit 4, and an AND device 9 which takes the logical product between the picture signal delivered from the data latch circuit 4 and the picture signal delayed through the delay circuit 11.

The pulse width adjuster 14 is similarly configured of a delay circuit 12 which delays and then transmits a luminance signal delivered from the data latch circuit 4, and an AND device 10 which takes the logical product between the luminance signal delivered from the data latch circuit 4 and the luminance signal delayed through the delay circuit 12.

Figure 2:
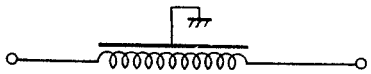
FIG. 2 is a diagram of the arrangement of a delay circuit employing a delay line element.
Figure 3:
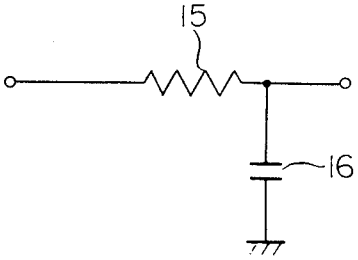
FIG. 3 is a diagram of the arrangement of a delay circuit made up of a T-circuit employing a resistor and a capacitor.

Examples of the setup of each of the delay circuits 11 and 12 are shown in FIGS. 2 and 3.

FIG. 2 shows the setup of the delay circuit employing a delay line element, while FIG. 3 shows the setup of the delay circuit made up of a T-circuit employing a resistor 15 and a capacitor 16.

Next, the operation of the present invention thus constructed will be described.

Figure 4:
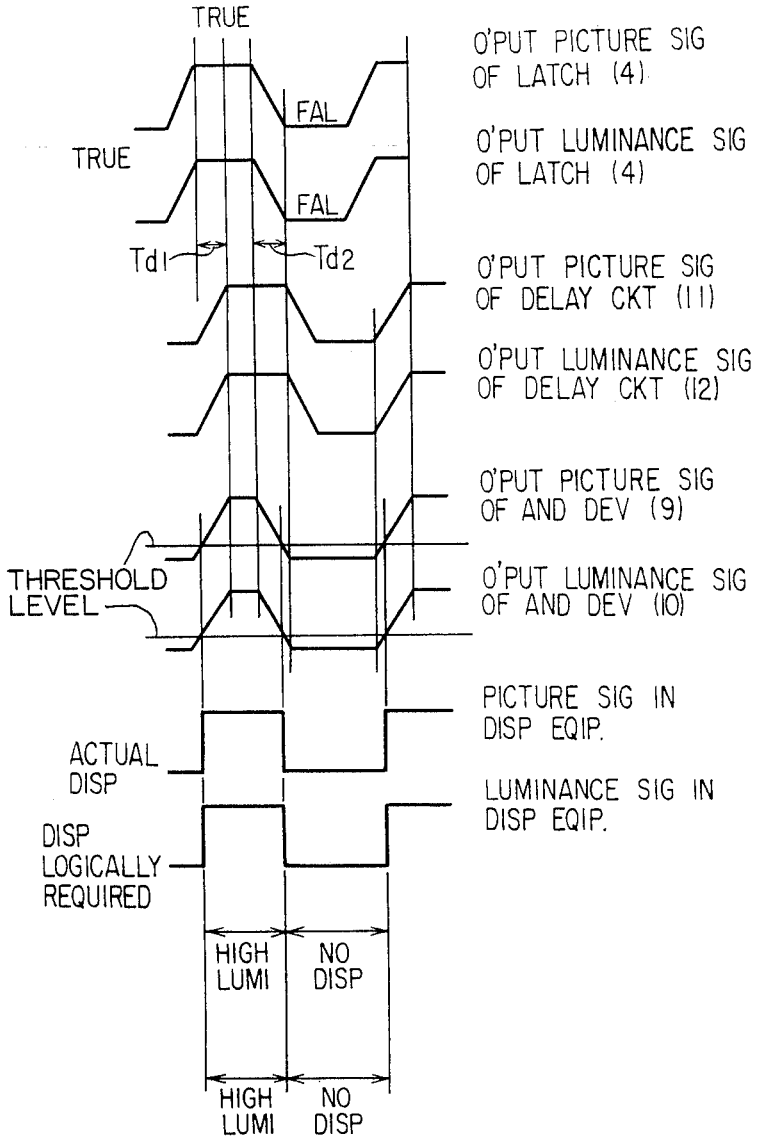
FIG. 4 is a waveform diagram expressing the relations between a picture signal and a luminance signal which are held when both the signals are true or false.
Figure 5:
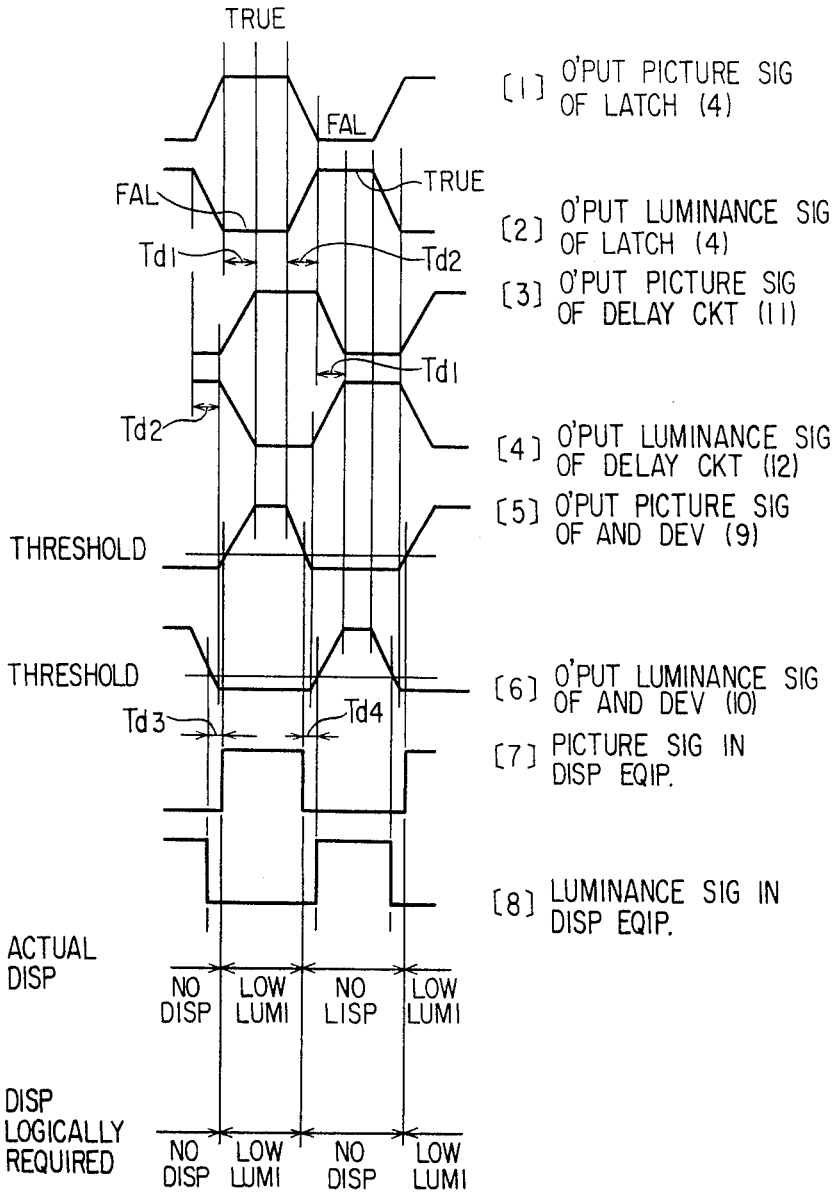
FIG. 5 is a waveform diagram expressing the relations between the picture signal and the luminance signal which are held when the signals are in any combination of true and false levels therebetween.
Figure 6:
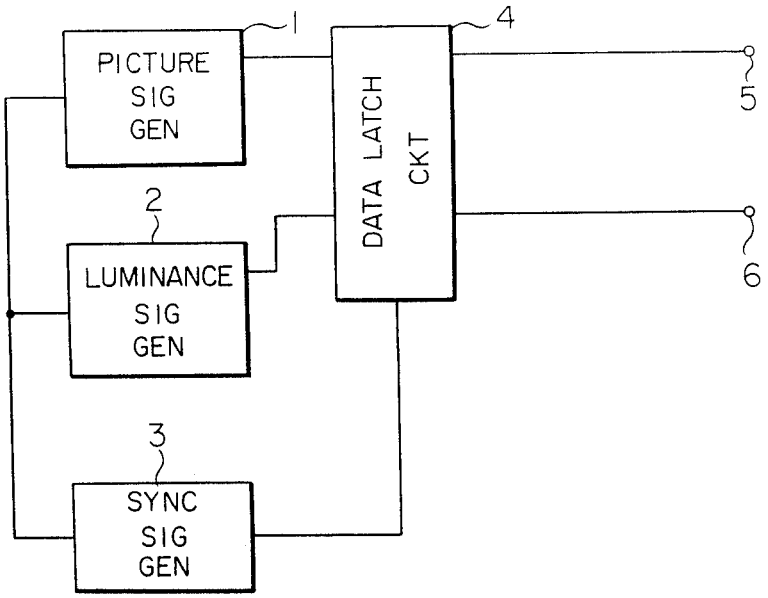
FIG. 6 PRIOR ART
FIG. 6 is a block diagram of a prior-art display control apparatus.
Figure 7:
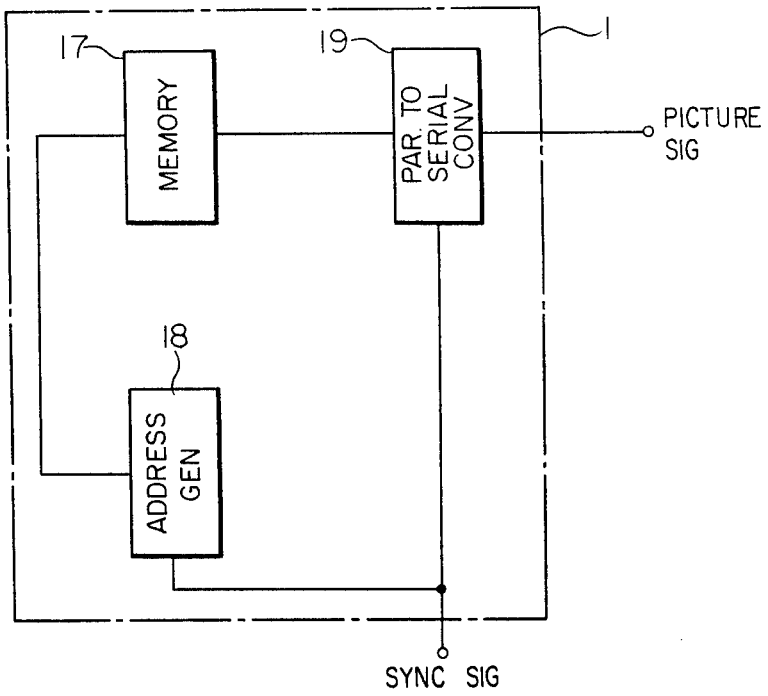
FIG. 7 PRIOR ART
FIG. 7 is a detailed block diagram of a picture signal generator in FIG. 6.
Figure 8:
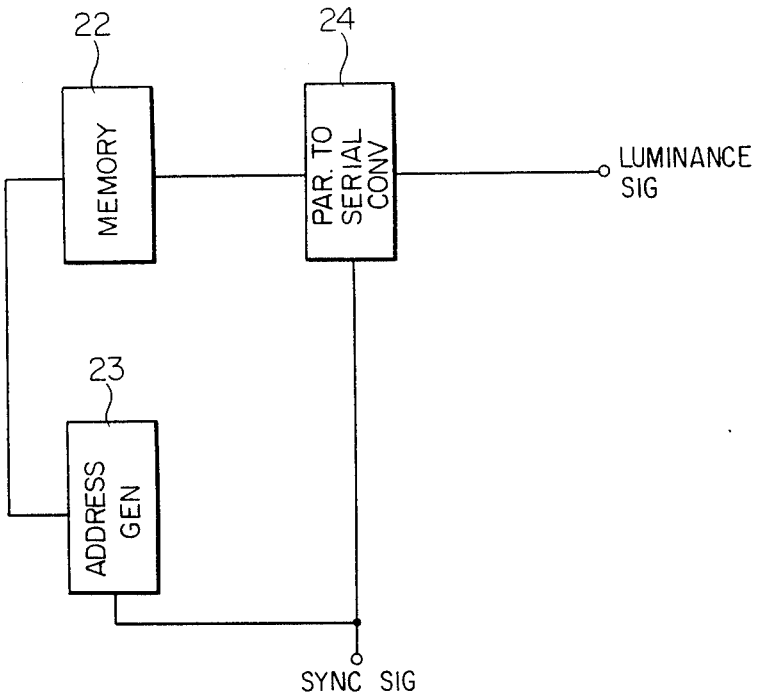
FIG. 8 PRIOR ART
FIG. 8 is a detailed block diagram of a luminance signal generator in FIG. 6.
Figure 9:
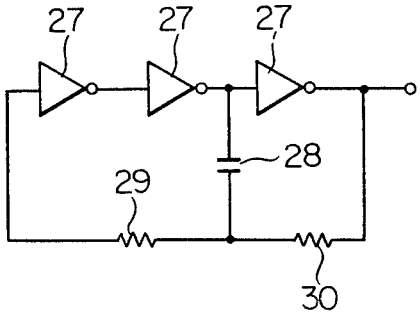
FIG. 9 PRIOR ART
FIG. 9 is a detailed block diagram of a sync signal generator in FIG. 6.
Figure 10:
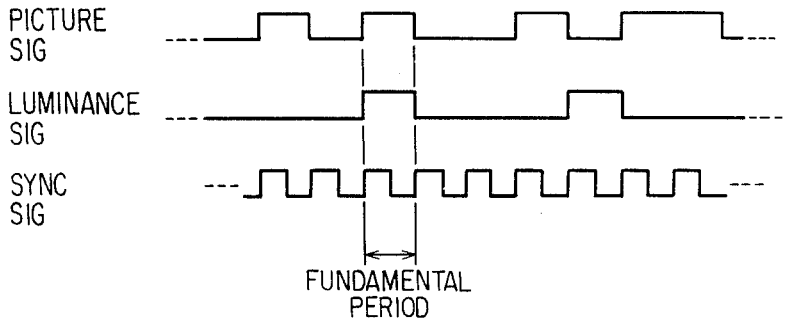
FIG. 10 is a diagram of the waveforms of a picture signal, a luminance signal and a sync signal.
Figure 11:
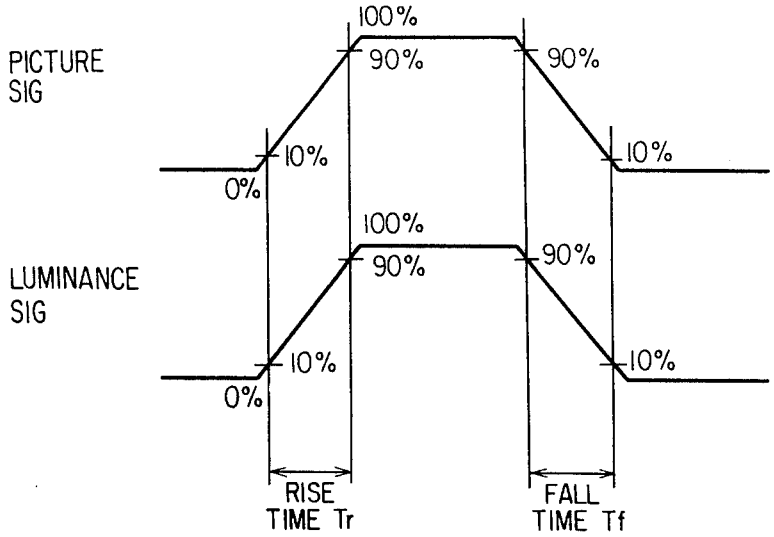
FIG. 11 is a diagram in which the waveforms in one cycle of the sync signal in FIG. 10 are enlarged.
Figures 12, 13:
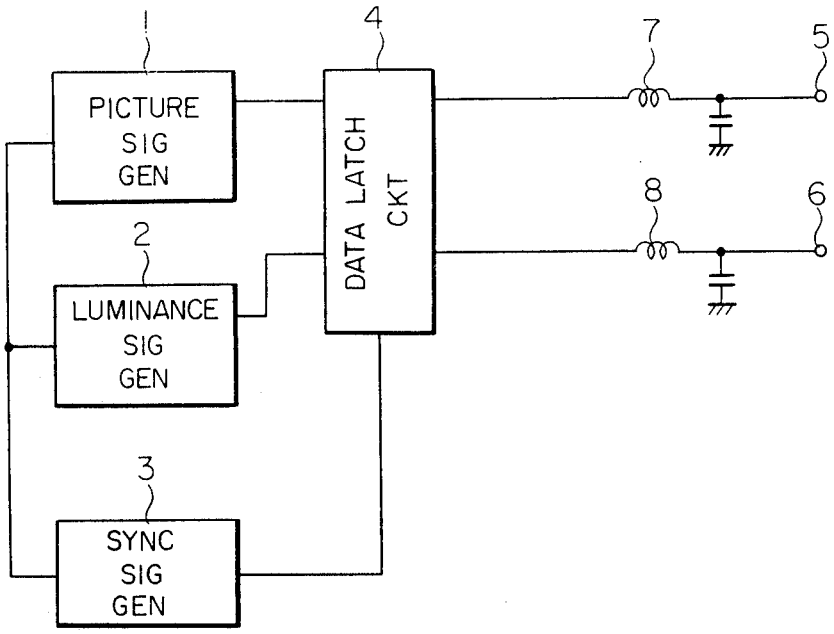
FIG. 12 PRIOR ART
FIG. 12 is a block diagram showing another arrangement of a prior-art display control apparatus.
FIG. 13 is a table expressing the relations of display statuses to the logics of the picture signal and the luminance signal.
Figure 14:
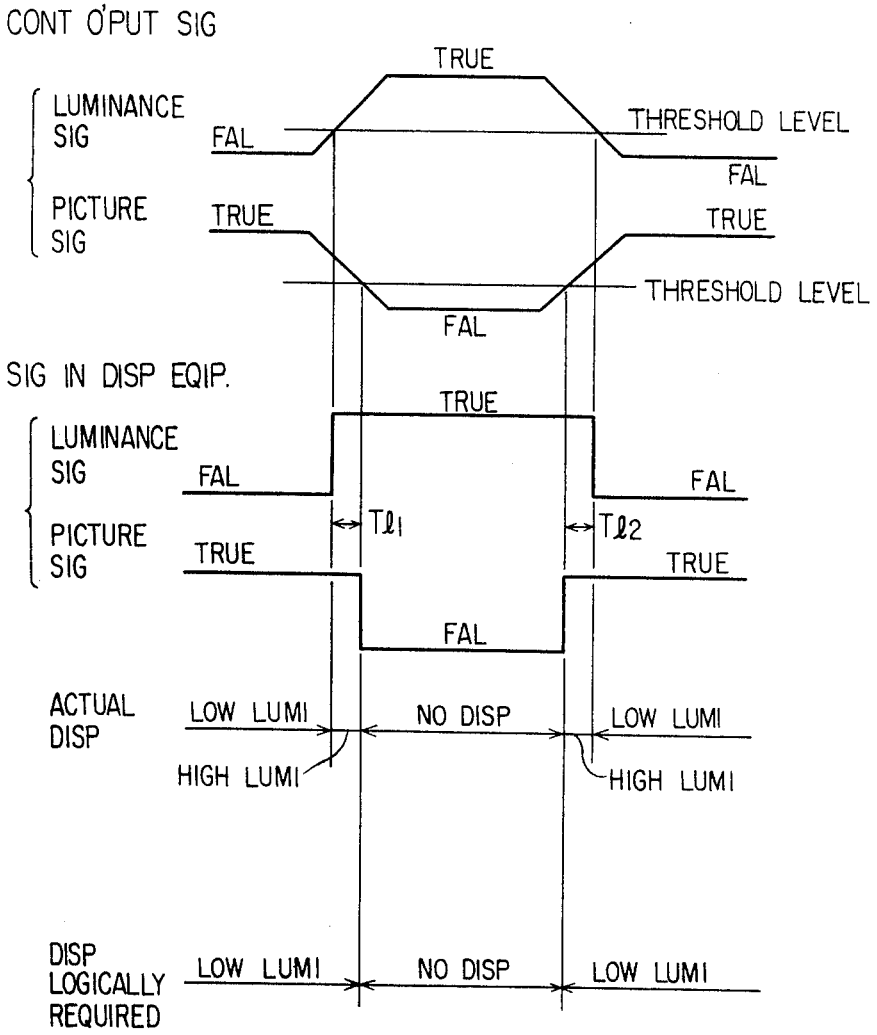
FIG. 14 PRIOR ART
FIG. 14 is a waveform diagram for elucidating a problem involved in the prior-art display control apparatus.

When the picture signal and the luminance signal whose phases are in agreement are provided from the data latch circuit 4 and are respectively applied to the pulse width adjusters 13 and 14, these pulse width adjusters 13 and 14 perform the following operations and then deliver the picture signal and luminance signal respectively:

Each of the signals impressed on the pulse width adjusters 13 and 14 is divided in two components, one of which enters an input terminal of the corresponding AND devices 9 or 10 and the other of which enters the corresponding delay circuits 11 or 12. Each of the signals applied to the delay circuits 11 and 12 is delayed for times $T_{d1}$ and $T_{d2}$ at the rise part and fall part thereof, respectively, and is thereafter applied to another input terminal of the corresponding AND device 9 or 10. The two signals applied to the AND device 9 or 10 have their logical product taken, whereupon a signal with a shortened true interval and a lengthened false interval is delivered to the picture signal line 5 or the luminance signal line 6. Since the delivered signals have phases in agreement, the true and false intervals thereof are respectively equal. Accordingly, a high luminance display is presented during the interval in which both the signals are true, and no display is presented during the interval in which they are both false. The relationship between the picture signal and the luminance signal on this occasion is illustrated in a waveform diagram of FIG. 4. As illustrated in FIG. 4, owing to the phases of the picture signal and the luminance signal held in agreement, even when the rise and fall times of the signals change or when the threshold levels thereof change, merely the pulse widths thereof change and the displays are normally presented. Besides, in a case where the picture signal and the luminance signal are in any combination of true and false levels therebetween, the relationship between the signals becomes as illustrated in FIG. 5.

More specifically, the signal delivered from the data latch circuit 4 is applied to the corresponding pulse width adjuster, the logical product between the applied signal and the signal with the rise and fall of the applied signal delayed for the times $T_{d1}$ and $T_{d2}$ respectively is taken, and the resulting signal is delivered to the picture signal line 5 or the luminance signal line 6. In each delay circuit, the rise and fall of the input signal are respectively subjected to the time delays $T_{d1}$ and $T_{d2}$, respectively. Since, however, the delayed signal has the logical product with the original signal taken by the AND device, a signal delayed only in rise with respect to the original signal is obtained. When the delayed signal is subjected to a binary decision with a certain fixed threshold level, a signal as shown in FIG. 5 is obtained. The signals thus obtained, indicated at [7] and [8] in FIG. 5, are such that the true logic interval of the true signal is shorter than the interval of the false signal by the sum $(T_{d3}+T_{d4})$ of fixed times $T_{d3}$ and $T_{d4}$ determined by the delay times and threshold levels of the delay circuits and lies within the false interval of the false signal, and that the false level is held for the fixed times before and after the true interval of the true signal.

As described above, the display control apparatus according to this invention comprises pulse width adjusters by which, when one signal is true with the other signal being false, the true signal is put within the interval of the false signal and is held false for fixed times before and after the true signal interval thereof, and when both the logics of the respective signals are true or false, the true or false intervals of both the signals are adjusted so as to become equal. Therefore, even when the logics of the signals are in the combination of the true and false logics, the true interval is rendered shorter than the false interval, and false logic times are set before and after the true logic interval, so that both the signals do not become true at the rises and falls thereof, and displays as logically required are presented.

What is claimed is:

1. A display control apparatus comprising:

a picture signal generator which produces a picture signal of a character, pattern, or the like;

a luminance signal generator which produces a luminance signal;

a synchronizing signal generator which produces a synchronizing synchronizing the picture signal produced from said picture signal generator and the luminance signal produced from said luminance signal generator and causes the synchronized picture signal and synchronized luminance signal to rise and fall at the same time;

data latch circuit which produces a synchronized picture signal from the picture signal and the synchronizing signal and a synchronized luminance signal from the luminance signal and the synchronizing signal;

a first pulse width adjuster receiving the synchronized picture signal as an input and comprising a delay circuit which produces a delayed synchronized picture signal from the synchronized picture signal and a logic circuit which performs a logical operation on the synchronized picture signal and the delayed synchronized picture signal and produces an output picture signal;

a second pulse width adjuster receiving the synchronized luminance signal as an input and comprising a delay circuit which produces a delayed synchronized luminance signal from the synchronized luminance signal and a logic circuit which performs a logical operation on the synchronized luminance signal and the delayed synchronized luminance signal and produces an output luminance signal;

when one of the synchronized picture signal and the synchronized luminance signal is true and the other is false, the one of said first and second pulse width adjusters with the true signal as it input producing and output signal having a shortened true interval and the other of said first and second pulse width adjusters with the false signal as it input producing an output signal having a widened false interval with the shortened true interval falling within the widened false interval, thereby producing a predetermined desired display signal; and when both the synchronized picture signal and the synchronized luminance signal are true or false, said first and second pulse width adjusters producing output signals having shortened true intervals or widened false intervals of equal length and having phases in agreement, thereby producing a predetermined desired display signal.

2. A display control apparatus as defined in claim 1 wherein said picture signal generator comprises a memory which stores pictures therein, an address generator which produces addresses which produce derived pictures from the pictures stored in said memory, and a parallel-to-serial converter which converts parallel signals of the derived pictures into serial signals and delivers the serial signals as the picture signal.

3. A display control apparatus as defined in claim 1 wherein said luminance signal generator comprises a memory which stores luminances therein, an address generator which produces addresses which produce derived luminances form the luminances stored in said memory, and a parallel-to-serial converter which converts parallel signals of the derived luminances into serial signals and delivers the serial signals as the luminance signal.

4. A display control apparatus as defined in claim 1 wherein said synchronizing signal generator comprises a first inverter, a second inverter, and a third inverter connected in series, a first resistor having one end thereof connected to the output end of said third inverter and the other end of said first resistor connected to one end of a second resistor with the other end of said second resistor connected to the input end of said first inverter, and a capacitor having one end connected to the output end of said second inverter and the other end of said capacitor connected to said other end of said first resistor.

5. A display control apparatus as defined in claim 1, wherein said each pulse width adjuster comprises a delay circuit which delays the signal for a fixed time, and and AND device which takes a logical product between the signal to enter said delay circuit and the delayed signal from said delay circuit.

* * * * *